US005644796A

United States Patent [19]

Laughlin

[11] Patent Number: 5,644,796

[45] Date of Patent: Jul. 8, 1997

[54] WORKGLOVE RAKE

[76] Inventor: George Eric Laughlin, 500 Victory Rd., Springfield, Ohio 45504

[21] Appl. No.: 665,718

[22] Filed: Jun. 20, 1996

[51] Int. Cl.[6] ..... A41D 19/00

[52] U.S. Cl. ..... 2/161.6; 2/163; 2/160

[58] Field of Search ..... 2/161.8, 161.6, 2/163, 160

[56] References Cited

U.S. PATENT DOCUMENTS

| | | | |
|---|---|---|---|
| 183,375 | 10/1876 | Cutliff | 2/161.8 |
| 251,571 | 12/1881 | Glidden | 2/161.6 |
| 883,761 | 4/1908 | Taylor | 2/161.8 |
| 1,128,556 | 2/1915 | Vincent | 2/161.8 |
| 2,895,139 | 7/1959 | Compton | 2/161.8 |
| 4,149,601 | 4/1979 | Taylor | 2/161.6 |
| 4,867,246 | 9/1989 | Kiger | 2/161.8 |

*Primary Examiner*—Bibhu Mohanty
*Attorney, Agent, or Firm*—William Weigl

[57] ABSTRACT

A pair of workgloves are provided with rake tines at the ends of the fingers. The tines extend outwardly from the palm side of the gloves so as to enable the gloves to be used in a raking fashion to clean debris such as leaves from rake-inaccessible places which can be reached by hand.

4 Claims, 1 Drawing Sheet

WORKGLOVE RAKE

This invention relates to a workglove or pair of gloves having fingertip tines used in the manner of a rake to enable hand-gathering of debris from places accessible to one's hand but inaccessible to a conventional large rake with a handle.

BACKGROUND OF THE INVENTION

Yard clean-up in the fall or spring oftentimes entails reaching into places by hand between and around shrubbery to gather leaves and other debris collected or blown there by the wind. Especially if picking up leaves, the person will usually use protective workgloves so as to avoid skin contact with insects, slimy wet debris or other objects which are unpleasant for many individuals to pick up by their bare hands. Then, if mulch is desired to be spread in the area which has been cleaned, it is usually desirable to evenly rake the spread mulch with the gloved hand or hands.

SUMMARY OF THE INVENTION

A pair of workgloves are provided with rake tines at the ends of the fingers. The tines extend outwardly from the palm side of the gloves so as to enable the gloves to be used in a raking fashion to clean rake-inaccessible places which can be reached by hand. The hands are protected by the gloves against touching unpleasant objects while also allowing the gloves to act as rakes to scrape up the debris. Once the debris is within reach after scraping, the hands can be cupped to hold and life the debris for placement into a container for disposal, or can be left in a pile for subsequent gathering with a standard handled rake. The gloves are of sufficient flexibility to allow the hand to be formed in fist fashion to grip the rake handle in a conventional manner.

A principal object of the invention is to provide a workglove with rake tines at the fingertips to enable hand raking of debris from relatively inaccessible places.

A more specific object is to provide a short, small rake wherein a protective workglove which covers the user's hands serves as the rake handle.

Another object is to prolong the useful life of a pair of workgloves by reducing wear at the fingertip areas through interposition of the tines between the fingertips and gathered debris.

Other objects and advantages will become apparent from the following description, in which reference is made to the accompanying drawings.

DESCRIPTION OF THE PREFERRED EMBODIMENTS

Figure 1:
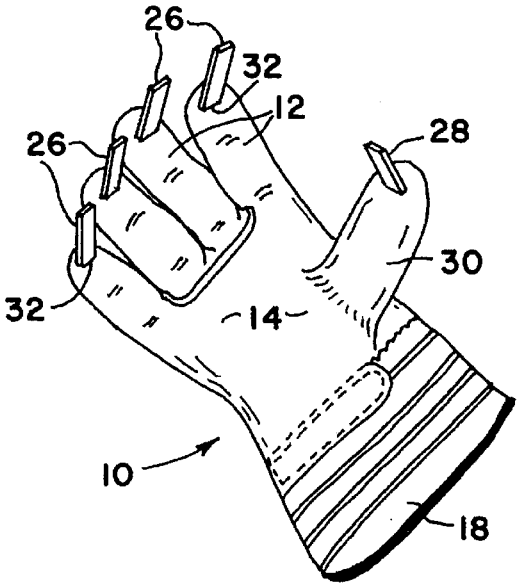
FIG. 1 is a palm side view of my workglove rake.
Figure 2:
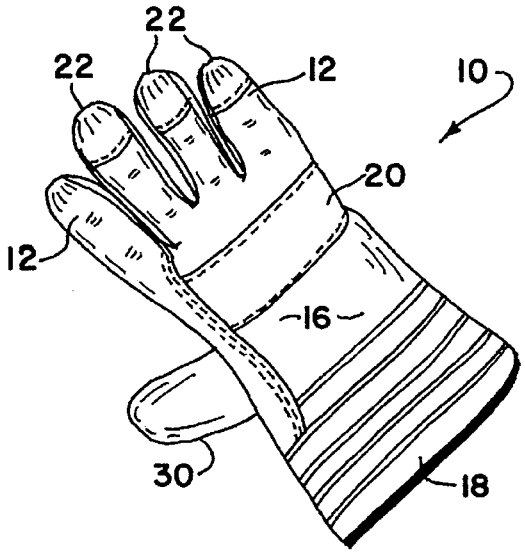
FIG. 2 is a back side view of the glove of FIG. 1.

A right-handed workglove 10 is shown in FIGS. 1 and 2. Preferably, the gloves are sold and used in pairs. The workglove 10 can be any type, but is ideally one which has finger extensions 12 which are relatively stiff against twisting along the length of the finger, but is sufficiently flexible to allow the glove the conform with an opening and closing of the hand to grasp and release objects or debris (not shown).

The glove 10 has a palm side 14 (FIG. 1), a back side 16 (FIG. 2) and a wrist-encircling cuff 12. The palm side 14 is preferably actual or simulated leather to provide stiffness to the fingers as mentioned above. The back side 16 has a knuckle-covering leather strip 20 and individual leather tips 22 above the wearer's fingernails. The remainder of the glove can be an appropriate protective cloth, with the cuff 18 including an interfacing material (not shown) to hold its shape. The cloth and leather sections are stitched in conventional fashion. A liner 24 (FIG. 3) is preferably provided inside the palm side 14 not only for hand protecting purposes, but also to avoid direct contact of one's fingers with blunt-ended tines 26 which are located at the tips of the finger extensions 12. As shown in FIG. 1, the tines 26 are of a width approximately one-third of the width of a finger extension 12 of the glove. A tine 28 may also be provided for a thumb extension 30 of the glove 10. The tine 28 does not serve so much as a rake tine, but more as a gripping instrument when debris is grasped in the gloved hand. The tine 28 functions only slightly in a hand-raking action, since a drawing, raking function of the hand presents only the side edge of the tine 28 to the debris being raked.

Figure 3:
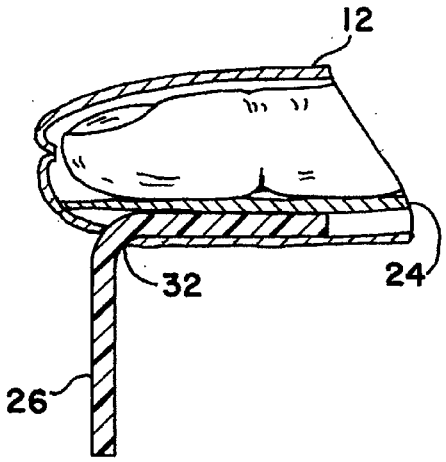
FIG. 3 is a fragmentary cross-sectional view of a finger extension of the glove, illustrating one form of finger attachment of a tine thereto.
Figure 4:
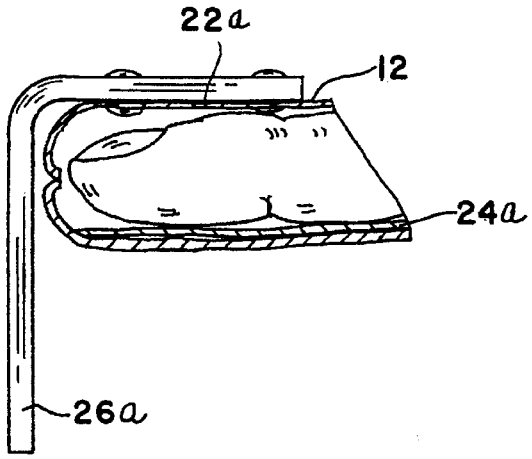
FIG. 4 is a view similar to FIG. 3, illustrating a modification of the means for attaching the tines to the finger extensions.

The tines 26 and 28 are preferably made of an appropriate polymer, one which has a molecularly aligned structure for maximum strength against breakage. They may also be made of metal such as a spring or other steel. The lines are generally L-shaped for purposes of attachment to the workglove 10. In FIG. 3, cross slits 32 are provided in the leather at the tips of the finger and thumb extensions, the tines are coated with an appropriate adhesive (not shown), one leg of each tine is inserted through a slit 32 between the leather and the liner 24 and the adhesive is permitted to set. To perform an effective leaf raking action, the tines 26 and **26*a* should protrude generally perpendicularly from the palm side of the fingers as shown in FIGS. 3 and 4**. Additionally, it is desired that the length of the tines be approximately the length of a person's fingertip to the first joint as seen in those same views.

The manner of attachment of the tines to the glove and the actual shape of a tine may be modified to suit any given design. In a variation of the invention shown in FIG. 4, tines **26*a* are attached to the leather tips 22*a* on the back side 16 of the glove 10**. They may be riveted thereto by pop rivets or attached by other means. The invention relates primarily to the existence of the tines essentially at the fingertips of the gloves, and not to the particular manner in which the tines are attached to the gloves.

Since reaching into small spaces is normally done with one hand and arm rather than two, a single right or left handed workglove may be used in conjunction with a standard workglove (or nothing) covering the other hand. Additionally, while all four fingers are depicted and preferred to contain tines, a lesser number of Lined fingers is within the scope of my invention. If one or more tines breaks or wears down, the others are still useful, just as with a full-sized rake with a long handle.

Various other changes may be made without departing from the spirit and scope of the invention.

Having described my invention, I claim:

1. A work glove for hand-gathering of leaves and loose debris from relatively inaccessible places within an arm's length of the person wearing the glove, said gathering taking place by means of a raking-like action in which the debris can be drawn toward the wearer; said glove comprising:

a unitary back side, palm side and finger and thumb extensions; and a relatively short, blunt-ended rake tine extending generally perpendicularly outwardly from the distal ends of a plurality of the finger extensions in the direction away from the palm side of the glove, said tines being of a length approximating the length of a user's fingers from the fingertip to the first joint, and being of a width approximating one third the width of a finger extension of said glove.

2. A work glove according to claim 1 wherein said tines comprise essentially L-shaped members, one leg of each tine being firmly affixed to the finger extension.

3. A work glove according to claim 1 wherein the material of which said glove is made is relatively stiff at least at the finger extensions whereby to resist rotation of the finger extensions about the fingers while maintaining the tines in raking position during performance of raking, and wherein the glove is otherwise sufficiently flexible and its palm side unobstructed to allow the user's gloved hand to be formed in fist fashion to grip the handle of a standard rake.

4. A work glove according to claim 3 wherein its back side and palm side are relatively flexible to enable closing of the gloved hand to grip the debris upon raking it into a position to be picked up, and to further enable the glove to be used to grip a handle of a standard rake without removing the glove.

* * * * *